US011441558B2

(12) United States Patent
Han et al.

(10) Patent No.: US 11,441,558 B2
(45) Date of Patent: Sep. 13, 2022

(54) GUIDE FOR PISTON OF HIGH-PRESSURE PUMP FOR VEHICLE

(71) Applicant: HYUNDAI KEFICO CORPORATION, Gyeonggi-do (KR)

(72) Inventors: Kyung Chul Han, Seoul (KR); Hyeong Kyun Park, Gyeonggi-do (KR); Jin Sung Kim, Seoul (KR); Chun Ky Hong, Gyeonggi-do (KR)

(73) Assignee: Hyundai Kefico Corporation, Gyeonggi-Do (KR)

( * ) Notice: Subject to any disclaimer, the term of this patent is extended or adjusted under 35 U.S.C. 154(b) by 0 days.

(21) Appl. No.: 17/122,463

(22) Filed: Dec. 15, 2020

(65) Prior Publication Data

US 2021/0180590 A1 Jun. 17, 2021

(30) Foreign Application Priority Data

Dec. 17, 2019 (KR) ..... 10-2019-0168522

(51) Int. Cl.

| | |
|---|---|
| ***F04B 53/16*** | (2006.01) |
| ***F04B 53/14*** | (2006.01) |
| ***F04B 19/04*** | (2006.01) |
| *F02M 59/44* | (2006.01) |

(52) U.S. Cl.

CPC ..... *F04B 53/16* (2013.01); *F04B 19/04* (2013.01); *F04B 53/14* (2013.01); *F02M 59/44* (2013.01)

(58) Field of Classification Search

CPC ..... F04B 19/04; F04B 53/14; F04B 53/16; F04B 53/166; F02M 59/44

See application file for complete search history.

(56) References Cited

U.S. PATENT DOCUMENTS

| | | | | |
|---|---|---|---|---|
| 8,215,646 | B2 * | 7/2012 | Castleman | F16J 15/166 277/552 |
| 2007/0283806 | A1 * | 12/2007 | Morrison | F04B 53/164 92/165 R |
| 2008/0122184 | A1 * | 5/2008 | Hocker | F16J 15/3236 277/366 |
| 2009/0044783 | A1 * | 2/2009 | Fischer | F02M 59/44 123/495 |
| 2016/0186742 | A1 * | 6/2016 | Bhat | F02M 59/025 92/172 |
| 2017/0009722 | A1 * | 1/2017 | Stritzel | F04B 19/22 |

FOREIGN PATENT DOCUMENTS

| | | | |
|---|---|---|---|
| JP | 2019157711 | A | 9/2019 |
| KR | 200373959 | Y1 | 1/2005 |
| KR | 1020060135948 | A | 12/2006 |
| KR | 101556627 | B1 | 10/2015 |
| KR | 1020160042454 | A | 4/2016 |

* cited by examiner

*Primary Examiner* — Connor J Tremarche

(74) *Attorney, Agent, or Firm* — Fox Rothschild LLP; Peter F. Corless

(57) ABSTRACT

A guide for a piston of a high-pressure pump includes: an upper body and a lower body, a connection part integrally connecting the upper body and the lower body, and a seal molded by an insert injection between the upper body and the lower body while surrounding the connection part. A gap exists between the upper body and the lower body, and the piston and the seal are in close contact with a piston. Therefore, it is possible to prevent leakage of fuel even while securing motion performance of the piston.

8 Claims, 5 Drawing Sheets

GUIDE FOR PISTON OF HIGH-PRESSURE PUMP FOR VEHICLE

CROSS-REFERENCE TO RELATED APPLICATION(S)

This application claims under 35 U.S.C. § 119 the benefit of Korean Patent Application No. 10-2019-0168522 filed on Dec. 17, 2019, the entire contents of which are incorporated herein by reference.

BACKGROUND

(a) Technical Field

The present disclosure relates to a high-pressure pump that generates fuel injection pressure in a gasoline direct injection engine, more particularly, to a guide guiding an operation path of a piston for compressing fuel while vertically and reciprocally moving inside the high-pressure pump.

(b) Description of the Related Art

A gasoline direct injection (GDI) engine is an engine that directly injects fuel into a combustion chamber of an engine, and is advantageous for improving fuel efficiency and reducing exhaust gas.

The fuel is primarily compressed by a low-pressure pump installed inside a fuel tank and pumped to a high-pressure pump through a fuel hose, secondarily compressed at a high pressure by the high-pressure pump connected to a fuel rail, and directly injected to each combustion chamber through an injector installed on the fuel rail.

Generally, as illustrated in FIG. 1 (RELATED ART), the high-pressure pump is configured as a structure in which a piston 2, a flow control valve 3, a discharge check valve 4, and a damper 5 are installed in a housing 1.

The piston 2 moves upward by a cam (located on the lower side of a piston, not illustrated) to compress the fuel inside a chamber 1*a*. The piston 2 moves downward from the location at which the piston 2 moves upward by the cam by a spring 6 to return to the original location. Such a process is repeated by the rotation of the cam, such that the fuel of the chamber 1*a* is continuously compressed and discharged.

The flow control valve 3 opens and closes the flow path connected to the chamber 1*a* to control the amount of fuel introduced into the chamber 1*a*.

The discharge check valve 4 is opened when the pressure within the chamber 1*a* increases above the pressure of the rear end of the discharge check valve 4 to discharge a high-pressure fuel.

The damper 5 is installed above the housing 1, and the fuel pumped from the low-pressure pump side is introduced into the damper 5 and passes through the damper 5 and then is supplied toward the flow control valve 3. The pulsation of the fuel is reduced by a diaphragm type damping member provided inside the damper 5.

A piston hole of the housing 1 is installed with a guide 7 surrounding the outer circumference of the piston 2. The guide 7 accurately maintains the vertical movement path of the piston 2 as a cylindrical member and protects the housing 1 and the piston 2 against friction.

Meanwhile, as illustrated in FIG. 2 (RELATED ART), a gap (G) exists between the piston 2 and the guide 7 such that the piston 2 may smoothly and vertically move. However, when the piston 2 is compressed, the fuel is leaked to the gap (G), thereby reducing the discharge efficiency of the high-pressure pump.

Therefore, the gap (G) is reduced, thereby minimizing the fuel leakage amount but since the operability of the piston 2 should be considered, there is a limit to reducing the gap (G), and since a fuel system is continuously subject to high pressures, a problem of reducing discharge efficiency of the high-pressure pump is not adequately addressed.

SUMMARY

Therefore, the present disclosure provides a guide for a piston of a high-pressure pump, which may prevent leakage of a fuel through a gap even while securing a sufficient gap enabling a normal motion of the piston, thereby preventing discharge efficiency of the high-pressure pump from being reduced.

A guide for a piston of a high-pressure pump according to an exemplary embodiment of the present disclosure may include: an upper body 11 and a lower body 12 having a cylindrical shape; a plurality of connection parts 13 integrally formed on the upper body 11 and the lower body 12 to connect the upper body 11 to the lower body 12; and a seal 20 provided in a space between the upper body 11 and the lower body 12 in a structure of surrounding the connection part 13.

At this time, piston holes 11*a*, 12*a* into which the piston 2 is inserted may be formed in the upper body 11 and the lower body 12, respectively, and the diameters of the piston holes 11*a*, 12*a* may be formed such that a gap (G) exists between the inner circumferential surface of each of the piston holes 11*a*, 12*a* and the outer circumferential surface of the piston 2.

Meanwhile, the seal 20 may be formed with a piston hole 21 into which the piston 2 is inserted, and the inner circumferential surface of the piston hole 21 may be in close contact with the outer circumferential surface of the piston 2.

Further, the seal 20 may be formed with connection part holes 22 of the same number as the number of connection parts 13, and the connection part 13 may be inserted into the connection part hole 22.

Further, the seal 20 may have a side groove 23 in the side surface thereof, and a plate spring 30 pushing the inner wall surface of the side groove 23 toward the piston 2 may be installed in the side groove 23.

At this time, the plate spring 30 may include: a bending part 32 connecting the support parts on both sides 31 having a plate shape to the lower end of the support parts on both sides 31, one side of the support parts on both sides 31 may be supported by a housing 1 of the high-pressure pump and an opposite side of the support parts on both sides 31 may be supported by the inner wall surface of the side groove 23.

Further, the seal 20 may have the lip 24 having a ring shape vertically formed in a plurality of columns, the lip 24 being disposed on the inner circumferential surface of the piston hole 21 of the piston 2 and in close contact with the outer circumferential surface of the piston 2.

Further, an inner diameter (D2) of the piston hole 12*a* of the lower body 12 may be formed larger than an inner diameter (D1) of the piston hole 11*a* of the upper body 11.

Further, a gripping part 12*b* having the reduced diameter may be formed on the lower end of the lower body 12, and the gripping part 12*b* may protrude to the outside of a guide installation hole 1*b* of a housing 1 of the high-pressure pump.

Further, the seal 20 may be molded by an insert injection in a space between the upper body 11 and the lower body 12.

According to the present disclosure described above, the seal which is in close contact with the outer circumferential surface of the piston is provided to prevent the leakage of the fuel through the gap even while securing the smooth motion performance of the piston, thereby improving the discharge efficiency of the high-pressure pump.

The connection part of the guide is inserted into the connection part hole formed in the seal, such that the seal may not be separated from the guide and the stable installation state may be permanently maintained.

The plate spring is provided on the seal and the inner circumferential surface of the seal is more strongly in close contact with the piston, thereby improving the fuel leakage prevention effect.

A plurality of lips contacting the piston is formed on the inner circumferential surface of the seal, thereby further improving the fuel leakage prevention effect.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DESCRIPTION OF SPECIFIC EMBODIMENTS

Figure 1:
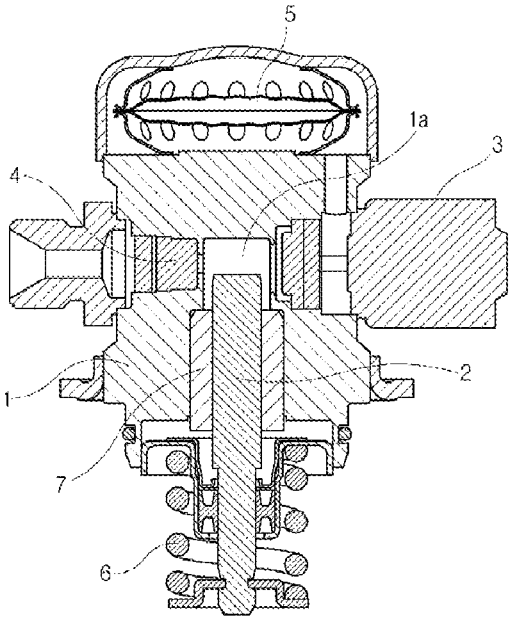
FIG. 1 (RELATED ART)
FIG. 1 (RELATED ART) is a cross-sectional diagram illustrating a configuration of a high-pressure pump.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Since the exemplary embodiments according to the present disclosure may be variously changed and have various forms, specific exemplary embodiments will be illustrated in the drawings and described in detail. However, this is not intended to limit the present disclosure to a particular disclosed form, and it should be understood that the present disclosure includes all changes, equivalents, and substitutes included in the spirit and technical scope of the present disclosure. The thicknesses of the lines, the sizes of the components illustrated in the accompanying drawings, or the like may be exaggeratedly illustrated for clarification and convenience of the description.

Further, terms to be described later are terms defined in consideration of functions in the present disclosure and may vary according to the intention or custom of the user or the operator. Therefore, these terms should be defined based on the contents throughout the present specification.

Hereinafter, a preferred exemplary embodiment of the present disclosure will be described in detail with reference to the accompanying drawings.

Figure 2:
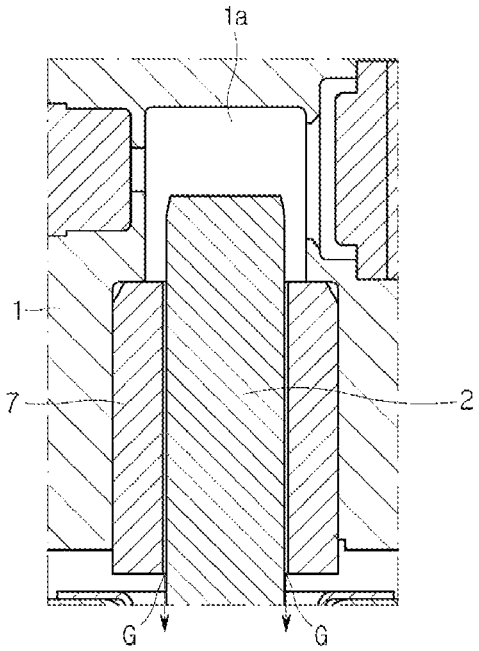
FIG. 2 (RELATED ART)
FIG. 2 (RELATED ART) is an enlarged diagram of a main portion of FIG. 1, and a cross-sectional diagram of the assembled state of a guide according to the related art.

The description of a structure of a high-pressure pump and a basic assembling structure of a piston and a guide may be obtained by referencing FIGS. 1 and 2, and the description of the related art described with reference to FIGS. 1 and 2.

Figure 3:
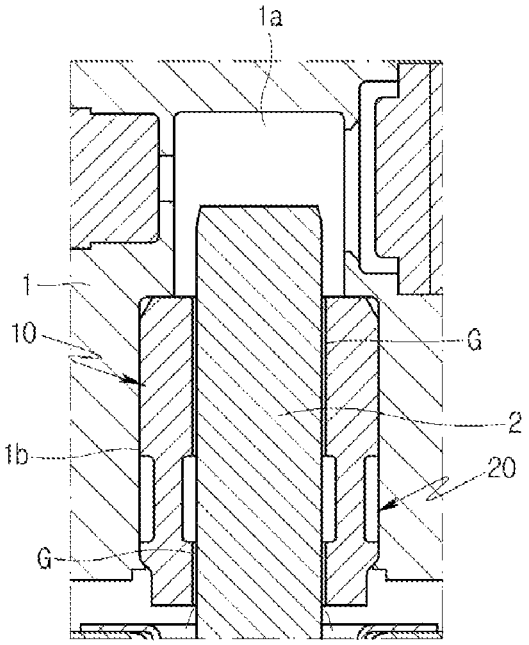
FIG. 3 is a corresponding diagram of FIG. 2, and a cross-sectional diagram of the assembled state of the guide according to the present disclosure.

As illustrated in FIG. 3, a guide 10 according to the present disclosure may integrally have a seal 20 which is in close contact with the outer circumferential surface of a piston 2 to block a gap (G) by the seal 20 even while securing the gap (G) between the guide 10 and the piston 2, thereby preventing leakage of fuel through the gap (G).

Figure 4:
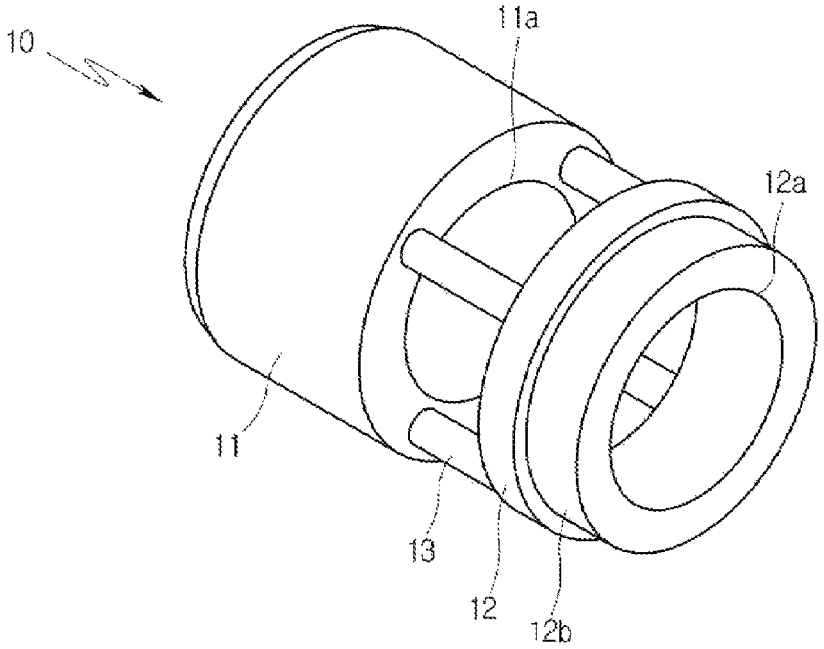
FIG. 4 is a perspective diagram of the guide according to the present disclosure.
Figure 5:
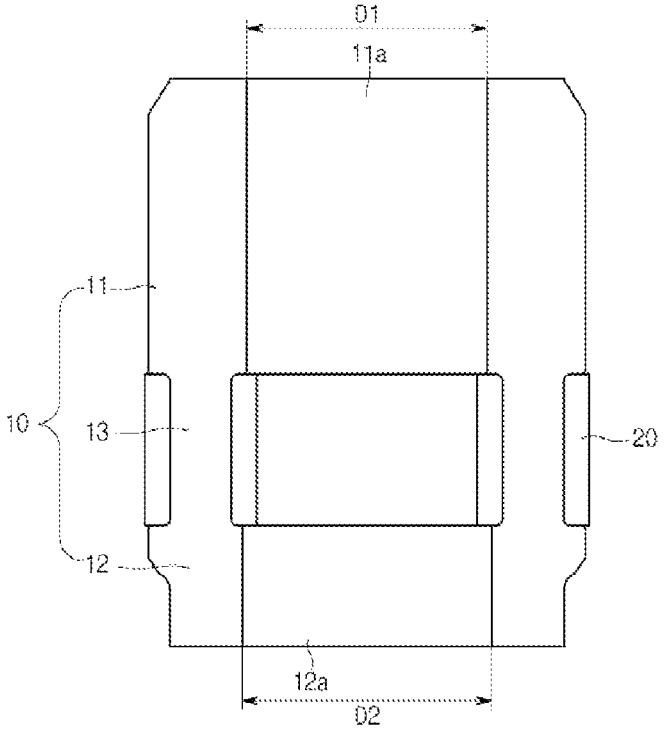
FIG. 5 is a longitudinal cross-sectional diagram of the guide according to the present disclosure.
Figure 6:
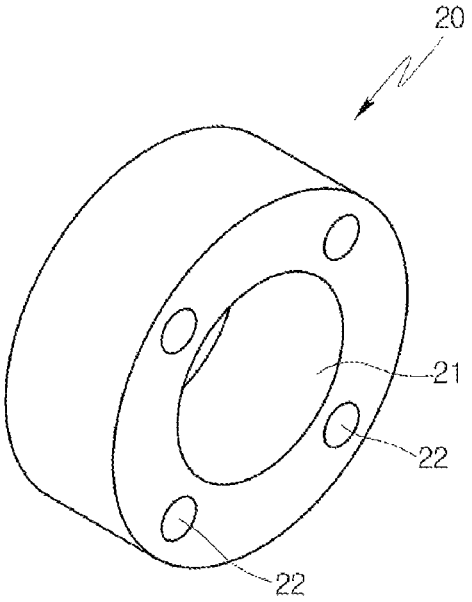
FIG. 6 is a perspective diagram of a seal which is one component of the present disclosure.

As illustrated in FIGS. 4 to 6, the guide 10 includes an upper body 11 and a lower body 12 having a cylindrical shape, a plurality of connection parts 13 connecting the upper body 11 to the lower body 12, and the seal 20 installed between the upper body 11 and the lower body 12 while surrounding the connection part 13.

The upper body 11 and the lower body 12 are cylinders having the same outer diameters and inserted into a guide installation hole 1*b* (see FIG. 3) formed in the housing 1. To have an appropriate fixing strength in the inserted state, the outer diameters of the upper body 11 and the lower body 12 are formed at the degree which is equal to or finely larger than the inner diameter of the guide installation hole 1*b*.

The vertical length of the upper body 11 is formed longer than the vertical length of the lower body 12. The relationship between the vertical lengths of the upper body 11 and the lower body 12 may be changed relatively depending on which portion the seal 20 is located on the entire guide 10.

The upper body 11 maintains the same outer diameter throughout the vertical direction whereas the lower body 12 is formed in a shape having the reduced diameter with a step in the lower portion compared to the upper portion thereof. The diameter reducing portion may be used as a gripping part 12*b* gripping the guide 10 by a tool when the guide 10 is inserted into or separated from the guide installation hole 1*b* of the housing 1.

Further, the inlet of the guide installation hole 1*b* may be caulked to cover a stepped portion of the upper end of the gripping part 12*b*, thereby being used for preventing the guide 10 from being separated from the guide installation hole 1*b*.

The gripping part 12*b* protrudes to the outside of the guide installation hole 1*b* in the state where the guide 10 is completely inserted into the guide installation hole 1*b* to avoid the interference between the tool and the housing 1, thereby facilitating the installation and separation work of the guide 10.

Piston holes 11*a*, 12*a*, which are vertically concentric to the center axes thereof, are formed inside the upper body 11 and the lower body 12. The piston holes 11*a*, 12*a* basically have the diameter of the same size as the size of adding the length of the gap (G) to the outer diameter of the piston 2. Therefore, when vertically moving, the piston 2 may smoothly and vertically move by securing the gap (G) between the inner circumferential surface of the guide 10 and the outer circumferential surface of the piston 2.

The connection part 13 integrally connects the upper body 11 to the lower body 12, and FIG. 4 illustrates a cylinder shape but the cross-sectional shape of the connection part 13 is not specially limited as long as the connection part 13 connects the upper body 11 to the lower body 12. Further, about three or four connection parts 13 are also appropriate such that the connection parts 13 are appropriately disposed at regular intervals in the circumferential direction of the guide 10 and not specially limited.

The guide 10 having the above shape may be produced by mechanically processing one cylindrical intermediate material. That is, the guide 10 may be produced by processing the inner/outer diameters of the upper body 11 and the lower body 12, processing the gripping part 12*b* on the lower body 12, leaving each connection part 13 between the upper body 11 and the lower body 12, and removing a portion corresponding to the remaining portion.

Further, the guide 10 may be produced by a metal powder injection molding (MIM) method. That is, the product is completed by making an intermediate product by injecting a material obtained by mixing a metal powder with a binder within a molding capable of obtaining a desired shape, removing a binder component by performing a skimming process for the intermediate product, and then sintering the intermediate product in which the binder component is removed. In this case, there is an advantage in that the shape of the connection part 13 is easily obtained compared to when being produced by the mechanical processing.

Meanwhile, the seal 20 preferably is formed by an insert injection method.

That is, a product in which the seal 20 having the above shape is integrally formed between the upper body 11 and the lower body 12 of the guide 10 may be obtained when the guide 10 is first inserted into the injection molding of the seal 20, and then a material of the seal 20 is melted and injected in a cavity of the molding, and then extracted after being cooled.

Individually describing the shape of the seal 20, as illustrated in FIG. 6, the seal 20 is a cylindrical member having a short length, and the seal 20 is made of a rubber material having the appropriate elasticity like a general sealing.

The upper surface and lower surface of the seal 20 are flat and formed with a piston hole 21, through which the piston 21 passes, therein. However, the piston hole 21 of the seal 20 is required to have the inner circumferential surface which is in close contact with the outer circumferential surface of the piston 2 in the state of having an appropriate pressure, and thus formed to have an outer diameter finely smaller than the outer diameter of the piston 2. Therefore, the inner circumferential surface of the seal 20 in the assembled state is in close contact with the outer circumferential surface of the piston 2 to block the gap (G), thereby preventing the leakage of the fuel by the seal 20.

The seal 20 is formed with a connection part hole 22 which vertically penetrates the seal 20. In the state where the molding of the seal 20 is completed by the insert injection, the connection part hole 22 becomes the state where the connection part 13 of the guide 10 is inserted. That is, since the seal 20 is formed in a structure of charging a space between the upper body 11 and the lower body 12 in the form of surrounding a plurality of connection parts 13, the guide 10 and the seal 20 are completely integrated in the state where the separation is not possible. Therefore, the seal 20 may maintain the robust installation state without being absolutely separated from the guide 10 despite the friction with the piston 2.

The inner circumferential surfaces of the piston hole 11*a* of the upper body 11 and the piston hole 12*a* of the lower body 12 may be precisely polished through a honing processing, thereby obtaining the accurate gap (G) between the inner circumferential surfaces and the piston 2 according to the design dimensions.

To prevent the damage to the seal 20 by a honing head upon the honing processing, an inner diameter (D2) of the piston hole 12*a* of the lower body 12 is preferably formed a little larger than an inner diameter (D1) of the piston hole 11*a* of the upper body 11 (D1<D2).

Figure 7:
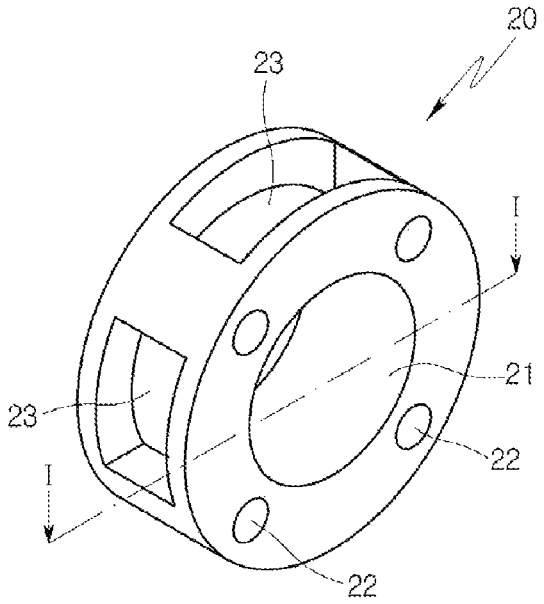
FIG. 7 is a diagram illustrating another exemplary embodiment of the seal.
Figure 8:
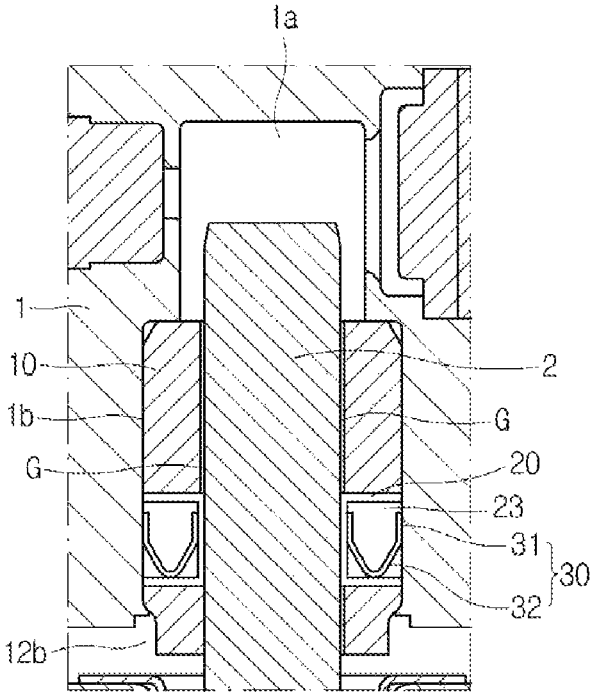
FIG. 8 is a cross-sectional diagram of the assembled state illustrating the state where the seal illustrated in FIG. 7 is applied, and a plate spring is installed on the seal (corresponding to the cross-sectional location taken along the line I-I illustrated in FIG. 7).

Meanwhile, as illustrated in FIG. 7, a plurality of side grooves 23 recessed inward along the outer circumferential surface of the seal 20 may be formed at regular intervals. The side grooves 23 are formed between the connection part holes 22 and formed in the same number as the number of connection part holes 22. As illustrated in FIG. 8, the side groove 23 is for installing the plate spring 30 therein.

The plate springs 30 are formed with support parts on both sides 31 having a flat plate shape on the upper portions of both sides thereof, and the lower end of the support parts on both sides 31 is formed in a structure of being connected by a V-shaped or U-shaped bending part 32, and installed inside the side groove 23 of the seal 20.

In the assembled state, each of the support parts on both sides 31 of the plate springs 30 is fitted between the inner circumferential surface of the guide installation hole 1*b* of the housing 1 and the inner wall surface of the side groove 23 in the compressed state, and therefore, the inner wall surface of the side groove 23 is pressed by the plate spring 30 toward the piston 2. Since the seal is made of an elastic deformable material, the inner circumferential surface of the seal 20 is more strongly in close contact with the outer circumferential surface of the piston 2 by the operation of the plate spring 30, thereby further improving the fuel leakage prevention performance by the seal 20.

Figure 9:
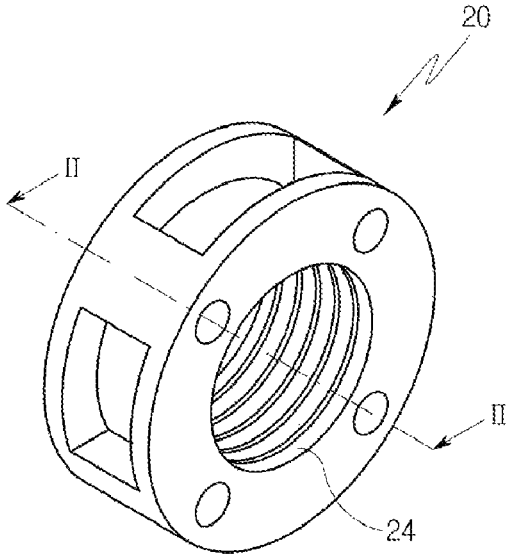
FIG. 9 is a diagram illustrating still another exemplary embodiment of the seal.
Figure 10:
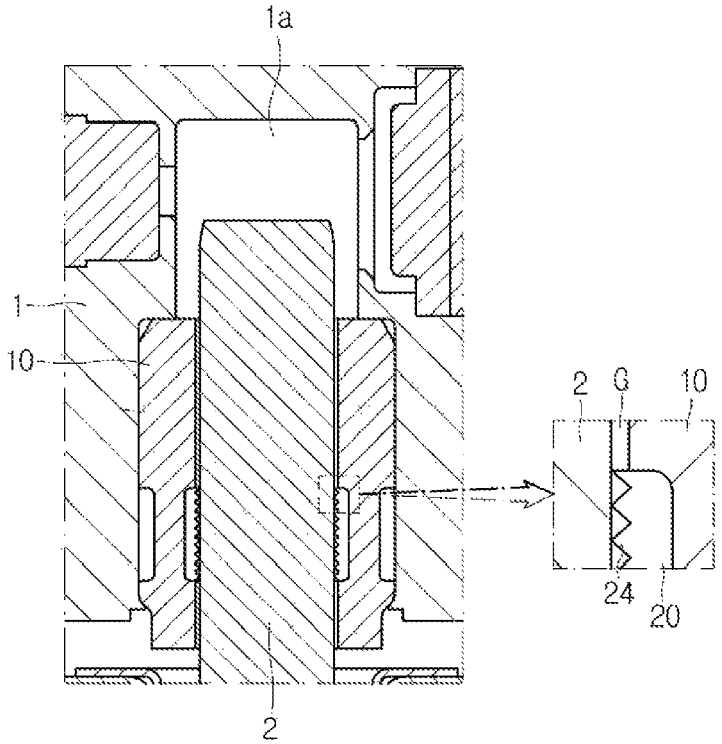
FIG. 10 is a cross-sectional diagram of the assembled state of the guide to which the seal illustrated in FIG. 9 is applied (corresponding to the cross-sectional location taken along the line II-II illustrated in FIG. 9).

Meanwhile, as illustrated in FIGS. 9 and 10, a lip 24 may be further formed on the inner circumferential surface of the piston hole 21 of the seal 20.

The lip 24 is formed in a ring shape throughout the circumference of the inner circumferential surface of the piston hole 21.

Further, a plurality of lips 24 may be consecutively formed vertically on the inner circumferential surface of the piston hole 21.

As illustrated, the end of the lip 24 may be formed to sharply protrude in a triangular cross-sectional shape, or formed in a round curved shape or the like. In any form, the lip 24 is in close contact with the outer circumferential surface of the piston 2 in the state of being compressed at a predetermined pressure, and forms a plurality of blocking lines in the leakage direction of the fuel according to the gap (G), thereby preventing the leakage of the fuel more reliably.

As described above, the piston guide of the high-pressure pump according to the present disclosure may have the seal 20 of the elastic material, which is in close contact with the outer circumferential surface of the piston 2, integrally provided on the guide 10, to prevent the leakage of the fuel through the gap (G) while securing the smooth vertical motion performance of the piston 2 by securing the gap (G), thereby preventing the discharge efficiency of the high-pressure pump from being reduced.

The seal 20 is formed in a structure in which the connection part 13 of the guide 10 is inserted into the connection part hole 22, that is, a guide integrated structure in which the seal 20 surrounds the plurality of connection parts 13, such that the separation from the guide 10 is not possible and the very stable installation state may be maintained.

Further, the side groove 23 is formed in the seal 20, and the plate spring 30 is installed in the side groove 23 to increase the contact force between the seal 20 and the piston 2, thereby improving the fuel leakage prevention effect by the seal 20.

Further, the plurality of lips 24 contacting the piston 2 may be formed on the inner circumferential surface of the seal 20, thereby further improving the fuel leakage prevention effect.

As described above, the present disclosure has been described with reference to the exemplary embodiment illustrated in the drawings, but this is merely illustrative, and it will be understood by those skilled in the art to which the present disclosure pertains that various modifications and other equivalent exemplary embodiments are possible. Therefore, the true technical scope of the present disclosure should be defined by the appended claims.

What is claimed is:

1. A guide for a piston of a high-pressure pump, the guide comprising:

an upper body and a lower body having a cylindrical shape;

a plurality of connection parts integrally formed on the upper body and the lower body to connect the upper body to the lower body; and a seal provided in a space between the upper body and the lower body in a structure of surrounding the connection part, wherein the seal is formed with connection part holes of a same number as a number of the connection parts, and wherein each of the connection part holes vertically penetrates the seal, and wherein each of the connection parts is inserted into one of the connection part holes, and wherein the seal is molded by an insert injection in a space between the upper body and the lower body.

2. The guide for the piston of the high-pressure pump of claim 1, wherein a piston hole into which the piston is inserted are formed in the upper body and the lower body, respectively, and wherein diameters of the piston holes are formed such that a gap exists between an inner circumferential surface of each of the piston holes and an outer circumferential surface of the piston.

3. The guide for the piston of the high-pressure pump of claim 1, wherein the seal is formed with a piston hole into which the piston is inserted, and wherein an inner circumferential surface of the piston hole is in close contact with an outer circumferential surface of the piston.

4. The guide for the piston of the high-pressure pump of claim 1, wherein the seal has a side groove in a side surface thereof, and wherein a plate spring pushing an inner wall surface of the side groove toward the piston is installed in the side groove.

5. The guide for the piston of the high-pressure pump of claim 4, wherein the plate spring comprises: a bending part connecting support parts on both sides having a plate shape to a lower end of the support parts on both sides and wherein one side of the support parts on both sides is supported by a housing of the high-pressure pump and an opposite side of the support parts on both sides is supported by an inner wall surface of the side groove.

6. The guide for the piston of the high-pressure pump of claim 1, wherein the seal has a lip having a ring shape vertically formed in a plurality of columns, the lip being disposed on an inner circumferential surface of a piston hole of the piston and in close contact with an outer circumferential surface of the piston.

7. The guide for the piston of the high-pressure pump of claim 1, wherein piston holes into which the piston is inserted are formed in the upper body and the lower body, respectively, and wherein an inner diameter of each of the piston holes of the lower body is formed larger than an inner diameter of each of the piston holes of the upper body.

8. The guide for the piston of the high-pressure pump of claim 1, wherein a gripping part having a reduced diameter is formed on a lower end of the lower body, and the gripping part protrudes to an outside of a guide installation hole of a housing of the high-pressure pump.

* * * * *